US005160256A

United States Patent [19]

Riehl

[11] Patent Number: 5,160,256

[45] Date of Patent: Nov. 3, 1992

[54] BURNER CONSTRUCTION, IGNITER ASSEMBLY THEREFOR AND METHODS OF MAKING THE SAME

[75] Inventor: Fred Riehl, Greensburg, Pa.

[73] Assignee: Robertshaw Controls Company, Richmond, Va.

[21] Appl. No.: 732,600

[22] Filed: Jul. 19, 1991

[51] Int. Cl.[5] ..... F23Q 3/00

[52] U.S. Cl. ..... 431/266; 126/39 E; 126/39 BA; 239/552; 29/592.1; 431/264

[58] Field of Search ..... 126/39 K, 39 H, 39 E, 126/39 BA; 431/266, 264; 239/552, 567, 568; 29/854, 33 R, 746, 592.1, 400.1

*Primary Examiner*—Larry Jones

*Attorney, Agent, or Firm*—Candor, Candor & Tassone

[57] ABSTRACT

A burner construction, igniter assembly therefor and methods of making the same are provided, the igniter assembly comprising an electrically insulating body member having an intermediate portion provided with a groove therein and having opposed end surfaces one of which is adapted to be disposed adjacent a cap of a burner construction, and an electrically conductive L-shaped electrode carried by the body member and having two legs one of which has a first part thereof disposed in the groove of the body member and has a second part extending out of the intermediate portion for sparking to the cap, the groove of the body member leading from the burner chamber to the second part of the one leg of the electrode between part of the one end surface and the intermediate portion of the body member for feeding fuel from the chamber to the second part of the one leg of the electrode.

20 Claims, 3 Drawing Sheets

BURNER CONSTRUCTION, IGNITER ASSEMBLY THEREFOR AND METHODS OF MAKING THE SAME

BACKGROUND OF THE INVENTION

1. Field of the Invention

This invention relates to a new burner construction and to a new igniter assembly for a burner construction as well as to new methods of making such a burner construction and such an igniter assembly.

2. Prior Art Statement

It is known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by a plurality of radially disposed groove means that are spaced apart by land means of the annular surface means, the cap means having an annular surface means cooperating with the annular surface means of the body means to close the groove means on one end thereof whereby the groove means define the port means, the annular surface means of the body means having an igniter receiving slot means therein, and an igniter assembly having a part thereof disposed in the slot means, the igniter assembly comprising an electrically insulating body member having an intermediate portion and having opposed end surface means one of which is disposed adjacent the cap means, and an electrically conductive L-shaped electrode means carried by the body member and having two legs one of which has a first part thereof disposed in the groove means of the body member and has a second part extending out of the intermediate portion for sparking to the cap means. For example, see applicant's allowed copending patent application, Ser. No. 508,799, filed Apr. 12, 1990.

Also, see applicant's issued U.S. Pat. No. 5,002,038 for a similar burner construction and an igniter assembly.

Also, see the Kwiatek U.S. Pat. No. 4,846,671, and the French patent to Sourdillon, No. 2,408,096, for other similar burner constructions and igniter assemblies.

SUMMARY OF THE INVENTION

It is one feature of this invention to provide a new burner construction that has a unique igniter assembly that assures a metered flow of fuel into the area of the ignition spark.

In particular, it was found according to the teachings of this invention that the igniter assembly for a burner construction can have the same groove means that receives one leg of an L-shaped conductive electrode carried by an electrically insulating body member and from which a part of the one leg of the electrode extends for sparking purposes provide a groove means for feeding fuel from the chamber means of the burner construction to the projecting part of the one leg of the electrode means for ignition purposes.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by the plurality of radially disposed groove means that are spaced apart by land means of the annular surface means, the cap means having an annular surface means cooperating with the annular surface means of the body means to close the groove means on one end thereof whereby the groove means define the port means, the annular surface means of the body means having an igniter receiving slot means therein, and an igniter assembly having a part thereof disposed in the slot means, the igniter assembly comprising an electrically insulating body member having an intermediate portion and having opposed end surface means one of which is disposed adjacent the cap means, and an electrically conductive L-shaped electrode means carried by the body member and having two legs one of which has a first part thereof disposed in the groove means of the body member and has a second part extending out of the intermediate portion for sparking to the cap means, the groove means of the body member leading from the chamber means to the second part of the one leg of the electrode means between part of the one end surface means and the intermediate portion of the body member for feeding fuel from the chamber means to the second part of the one leg of the electrode means.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Another object of this invention is to provide a new igniter assembly for a burner construction, the igniter assembly of this invention having one or more of the novel features of this invention as set forth above or hereinafter shown or described.

Another object of this invention is to provide a new method of making such an igniter assembly, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
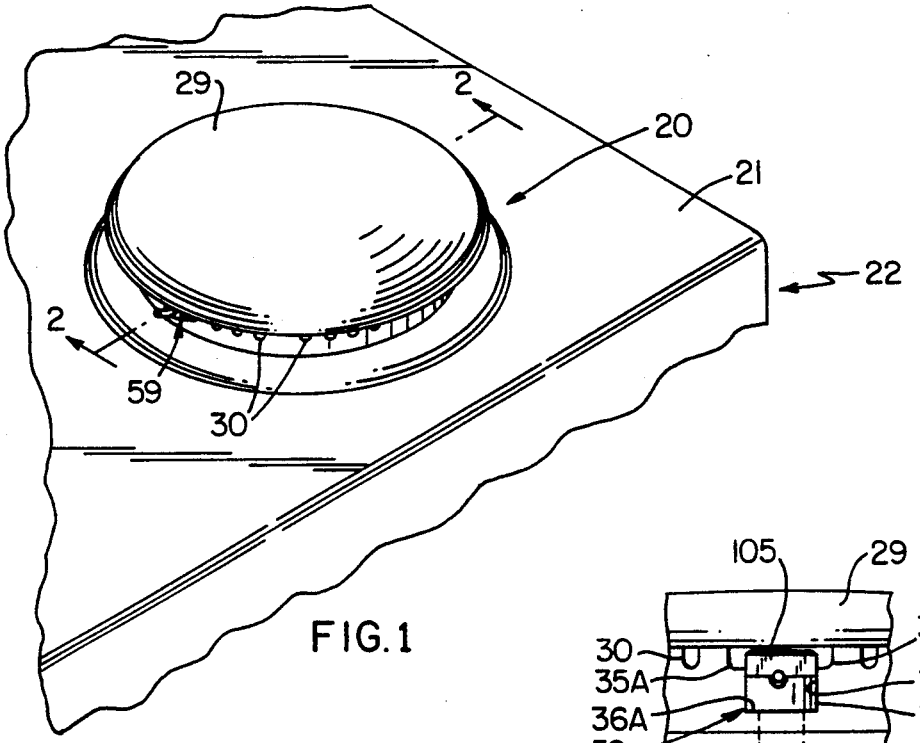
FIG. 1 is a fragmentary top perspective view illustrating the new burner construction of this invention mounted in a range top of a cooking apparatus.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

The burner construction of this invention is of a type that is similar to the burner constructions that are set forth in applicant's aforementioned allowed copending patent application, Ser. No. 508,799, filed Apr. 12, 1990, and applicant's issued patent No. 5,002,038, whereby this allowed copending patent application and this issued patent are respectively being incorporated into this disclosure by this reference thereto. However, since the igniter assembly of this invention has unique features over the igniter assemblies of applicant's prior mentioned copending patent application and issued patent, certain of the details of the burner construction of this invention that are believed necessary to understand the features of this invention will now be set forth.

Referring now to FIGS. 1-4, the new burner construction of this invention is generally indicated by the reference numeral 20 and is illustrated in FIG. 1 as being sealed to the range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a fuel source 28 with the chamber means 24 in a manner hereinafter set forth.

The burner construction 20 also comprises a removable cap means 29 closing the open end means 25 of the burner body means 23, the burner construction 20 having a plurality of port means 30 interconnecting the chamber means 24 to the exterior of the burner construction 20 and through which fuel can issue to burn externally to the burner construction 20 in a manner well known in the art. For example, not only see the aforementioned allowed copending patent application of applicant, Ser. No. 508,799, filed Apr. 12, 1990, and applicant's aforementioned issued U.S. Pat. No. 5,002,038, but also see the aforementioned Kwiatek U.S. Pat. No. 4,846,671, and the aforementioned French patent to Sourdillon, No. 2,408,096, whereby these last two patents are also being incorporated into this disclosure by this reference thereto.

While the burner body means 23 and removable cap means 29 of the burner construction 20 of this invention can be formed of any suitable material or combination of materials, such as metallic material, one working embodiment thereof has the body means 23 and cap means 29 each formed of die cast aluminum RMS-105 whereby the two main parts of the burner construction 20, namely the burner body means 23 and cap means 29, can be manufactured as two castings without machine processes and thereby having a reduced manufacturing cost.

Figure 4:
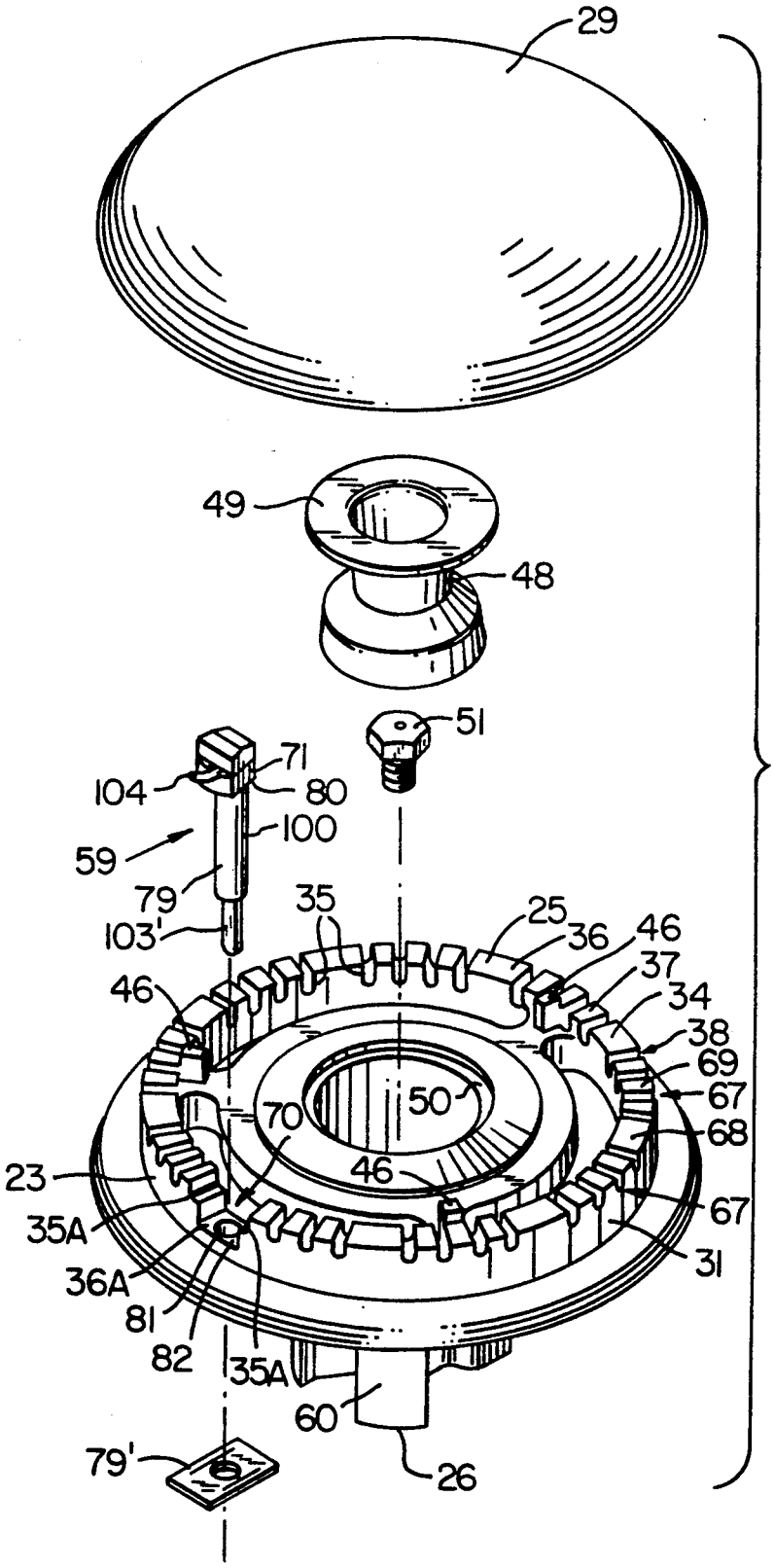
FIG. 4 is an exploded perspective view of the various parts of the burner construction of FIGS. 1-3.
Figure 5:
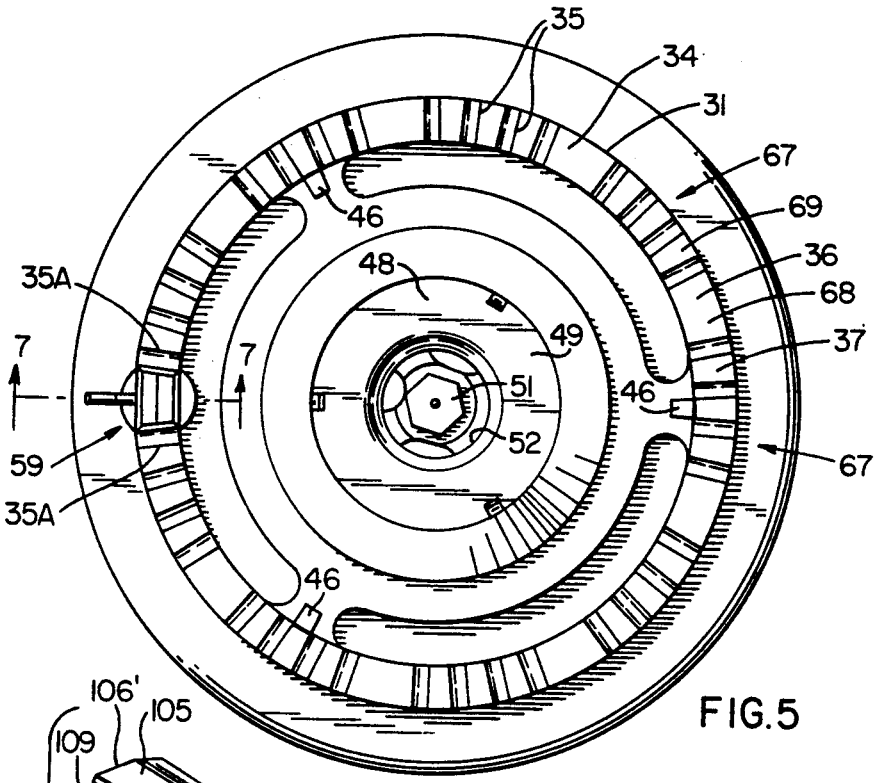
FIG. 5 is a cross-sectional view of the burner construction of FIG. 2 and is generally taken in the direction of the arrows 5—5 of FIG. 2.

The body means 23 has an annular wall 31 provided with an annular substantially flat top surface 34 interrupted by a plurality of radially disposed and spaced apart U-shaped grooves 35 disposed in the circular array pattern as illustrated in FIGS. 4 and 5, the groove means 35 being separated by ungrooved land means 36 and 37 of the annular surface means 34 in a unique patterned arrangement that will be hereinafter set forth.

Figure 3:
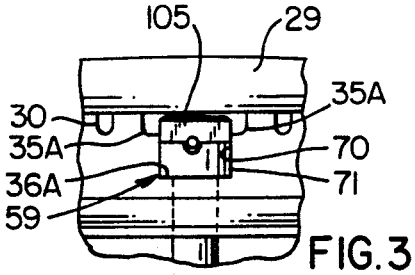
FIG. 3 is a fragmentary view looking toward the igniter assembly of the burner construction of FIG. 2, FIG. 3 being taken generally in the direction of the arrows 3—3 of FIG. 2.
Figure 2:
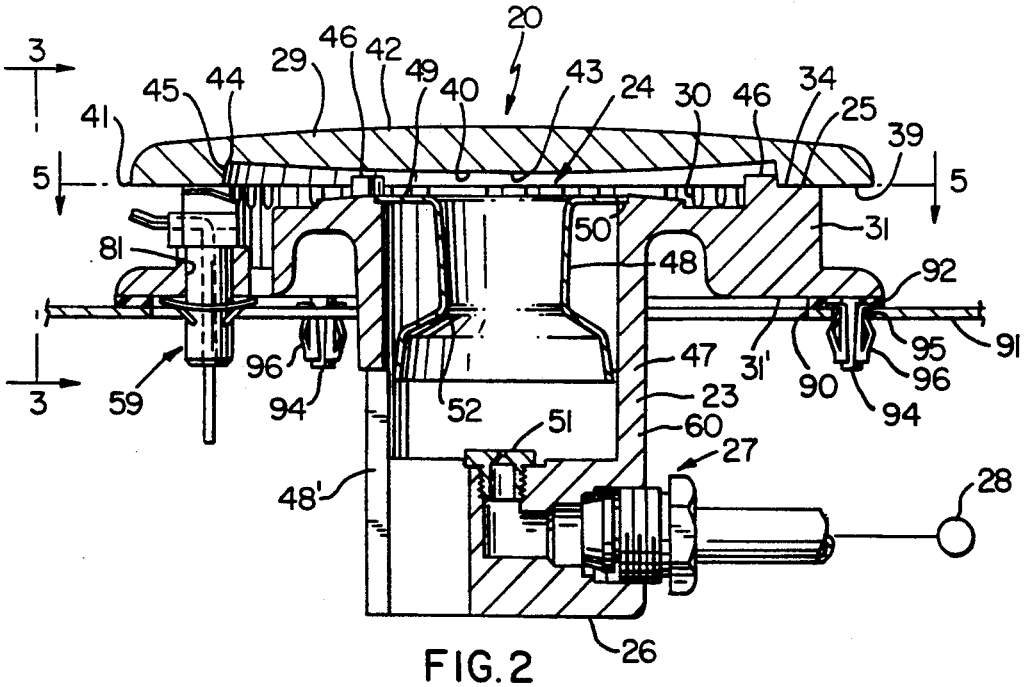
FIG. 2 is an enlarged fragmentary cross-sectional view taken on line 2—2 of FIG. 1.
Figure 6:
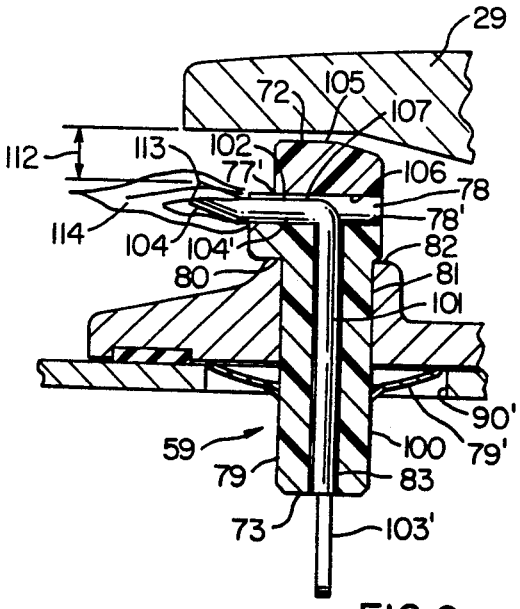
FIG. 6 is an enlarged fragmentary cross-sectional view of the burner construction and is taken on line 6—6 of FIG. 5.

The grooves 35 in the body member 23 are adapted to be closed at the open ends 38 thereof by a substantially flat annular surface means 39 formed on a side 40 of the cap means 29 when the cap means 29 is disposed in its closing position on the open end 25 of the body means 23 in the manner illustrated in FIGS. 2, 3 and 6 so as to cooperate with the grooves 35 to define the port means 30 previously set forth.

The cap means 29 has an annular peripheral edge means 41 that interconnects the side 40 of the cap means 29 with an opposed side 42 thereof, the side 42 being generally conical and the side 40 also having a central conical portion 43 that has its larger base 44 joining with the flat annular portion 39 by an angled surface means 45 which is adapted to engage against a plurality of upwardly standing abutments 46 of the body member 23 so as to orient the cap 29 in its rotational position on the end 25 of the body means 23 so that the annular surface means 39 thereof will close the U-shaped grooves 35 to form the ports 30 as previously set forth.

The chamber means 24 of the body member 23 has a cylindrical portion 47 in which a removable venturi member 48 is disposed and has an upper annular flange means 49 that rests on an annular shoulder 50 of the body means 23 as illustrated in FIG. 2 so that the flow of fuel out of an orifice means 51 must pass through a throat 52 of the venturi member 48 before the same can reach the chamber means 24 to pass out through the ports 30 all for the reasons fully set forth in the aforementioned Riehl U.S. Pat. No. 5,002,038, the flow of fuel through the venturi member 48 drawing primary air through the opening means 48' in the wall 47 to mix with the fuel also in a manner will known in the art.

The groove means 35 that are formed in the wall 31 of the burner body means 23 to subsequently form the port means 30 are so constructed and arranged that the same define a substantially repeating patter of a set 67 of four grooves 35 separated from each other by land means 37 and then separated from the next set 67 of four grooves 35 and their intermediate land means 37 by a large land means 36 that has an annular length or circumferential length greater than the annular or circumferential length of each of the lands 37 of the two adjacent sets 67 as illustrated. In addition, the separating lands 36 each has a free end flat surface 68 that is recessed below the free end flat surfaces 69 of the lands 37 so as to provide for carry-over flame means between each set 67 of port means so that once ignition of fuel issuing from one or more port means 30 is accomplished by an igniter assembly 59 of this invention in the manner hereinafter set forth, flame propagation will be provided completely around the burner body means 23 at each port means 30 thereof.

One of the larger land means 36 of the burner construction 20 of this invention is indicated by the reference numeral 36A in FIG. 4 and one of the legs of the groove means 35A on each side of the land means 36A are cut away to form a substantially truncated triangular slot means 70 therein to receive an enlarged substantially truncated triangular intermediate portion 71 of the igniter assembly 59 therein in the manner illustrated in FIGS. 2, 3, 5 and 6 and hereinafter set forth.

It has been found in one working embodiment of the burner construction 20 of this invention wherein the width of the annular surface 34 of the wall 31 of the burner body means 23 is slightly greater than approximately 0.250 of an inch, the grooves 35 each can have a width at the open end 38 thereof of approximately 0.062 of an inch and a depth of approximately 0.115 of an inch while the U-shaped end thereof is defined by a radius that is ½ of the width of the respective groove 35. The outer surfaces 68 of the separating lands 36 are each recessed below the outer surfaces 69 of the lands 37 by approximately 0.015 of an inch while the annular or circumferential length of the surface 68 of each of the separating lands is approximately 0.315 of an inch and the annular or circumferential length of the surface 69 of each land 37 is approximately 0.125 of an inch.

While the burner body means 23 of the burner construction 20 of this invention can be mounted to the top surface means 21 of the cooking apparatus 22 in any suitable manner, the embodiment of the burner construction 20 illustrated in the drawings is adapted to have a lower portion 60 of the burner body means 23 inserted through a suitable circular opening 90 formed through a top wall 91 of the cooking apparatus 22 that has the top surface means 21 as illustrated in FIG. 2 and be sealed thereto by conventional annular sealing means 92 so as to space the lower surface 31' of the burner body means 23 slightly above the top surface 21 of the wall means 91 in order to prevent heat of the burner construction 20 from being transferred by conduction to the wall 91 through intimate contact with the metallic material of the burner construction 20 with the wall means 91.

The wall means 31 of the burner body 23 has a plurality, such as three, tapering projection 94 formed integrally therewith and extending downwardly therefrom so as to be adapted to pass through cooperating openings 95 through the wall 91 at the same time that the portion 60 of the burner body means 23 is being inserted through the large opening 90, the projection 94 being held in the inserted position thereof by conventional spring clip means 96 in a conventional manner for such type of clip means and as set forth in the aforementioned allowed copending patent application 508,799, filed Apr. 12, 1990.

Figure 7:
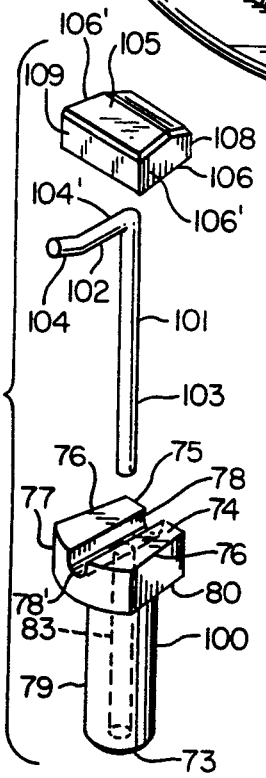
FIG. 7 is an exploded perspective view of the various parts that form the igniter assembly of this invention.

The unique igniter assembly 59 of this invention comprises an electrically insulating body member 100 formed of any suitable material, such as a suitable ceramic material known as L3 Steatite, and has the enlarged intermediate portion 71 and opposed end surface means 72 and 73. The intermediate part 71 has a substantially flat transverse surface 74 that defines a generally truncated triangular configuration having a smaller base or side 75, angled sides 76 and an arcuate larger base or side 77 as illustrated in FIG. 7, the surface 74 being interrupted by a U-shaped groove or slot 78 that extends from the smaller base, 75 to the larger base 77 substantially centrally through the surface 74 as illustrated.

The body member 100 of the igniter assembly 59 has a cylindrical or post-like portion 79 extending from a lower surface 80 of the enlarged intermediate portion 71 as illustrated and is adapted to pass down through a circular opening 81 formed through a surface 82 of the burner body means 23 created by the slot 36A as illustrated so that the lower surface 80 of the body 100 will rest against the surface 82 in the manner illustrated in FIG. 6 while the angled sides 76 of the enlarged portion 71 cooperate with the grooves 35A to complete the missing legs thereof in the manner illustrated in FIG. 3 so that fuel can flow out of the grooves 35A on each side of the igniter assembly 59 in generally the same amount and with generally the same flow rate as the fuel issuing out of the other ports 30 of the burner construction 20.

In order to mount the igniter assembly 59 in place, a spring clip 79' can be telescopically disposed on the portion 79 of the body member 100 to engage against the underside 31' of the burner body means 23 as illustrated in FIG. 6 and the wall 91 of the cooking apparatus 22 can be provided with a suitable opening 90' to not only receive the cylindrical portion 79 of the igniter assembly 59 therethrough, but also the spring clip means 79' as illustrated in FIG. 6.

The body member 100 of the igniter assembly 59 has an opening 83 passing substantially centrally through the cylindrical portion 79 thereof to join at one end thereof with the slot 78 and to interrupt the lower end surface mean 73 at the other end thereof.

The igniter assembly 59 also includes an L-shaped conductive electrode means 101 formed of any suitable metallic material and having two legs 102 and 103 disposed at substantially a 90° angle relative to each other with the leg 102 having an end portion 104 angled upwardly from a non-angled portion 104' thereof for a purpose hereinafter set forth.

In one working embodiment of the igniter assembly 59 of this invention, the electrode means 101 comprises a stainless steel wire or rod that is approximately 0.062 of an inch in diameter and initially has the leg 103 with a length of approximately 1.006 of an inch and with the leg 102 being approximately 0.397 of an inch in length, the end portion 104 of the leg 102 being angled at an angle of approximately 20° so that the unangled portion 104' of the leg 102 is approximately 0.285 of an inch in length.

The igniter assembly 59 is formed by the method of this invention by inserting the leg 103 of the electrode means 101 down through the opening 83 so that the portion 104' of the leg 102 will be received in the groove or slot 78 and bottom out against the lower surface 78' thereof as illustrated in FIG. 6 whereby the protruding portion 103' of the leg 103 that extends beyond the end surface means 73 of the body member 100 can be swaged or enlarged so as to contact against the surface means 73 and thereby prevent the electrode 101 from thereafter being pulled out of the openings 83 and 78.

Thereafter, an electrically insulating cover member 105 of the igniter assembly 59 has its lower flat surface 106 secured to the flat surface 74 of the enlarged intermediate portion 71 of the body member 100 in any suitable manner so as to extend from the smaller base 75 thereof to a point 77', FIG. 6, that is short of the larger base 77 thereof while covering part of the portion 104' of the leg 102 in the spaced manner illustrated in FIG. 6 for a purpose hereinafter set forth.

While the cover member 105 can be formed of any suitable material, in the one working embodiment of this invention, the cover member 105 is formed of the ceramic material, L3 Steatite, that forms the rest of the igniter body member 100 and is secured thereto by any suitable ceramic adhesive means in a manner well known in the art.

In this manner, the cover member 105 and the uncovered portion of the surface 74 of the intermediate portion 71 define the end surface means 72 of the body member 100.

However, since the top surface 107 of the part 104' of the leg 102 of the electrode means 101 is spaced below the lower surface 106 of the cover member 105 in the manner illustrated in FIG. 6, fuel will issue from the chamber means 24 of the burner construction 20 out through the slot means 78 to be disposed in a spark gap 112 defined between a tip 113 of the angled part 104 of the electrode 101 and the surface 39 of the cap means 29 so as to be ignited by sparking that is created between the electrode means 101 and the cap means 29 and thereby create the ignition flames 114 which will then through flame propagation ignite the fuel issuing from the adjacent port means 35A and the subsequent adjacent port means 30 all in a manner well known in the art.

In this manner, it is believed that the groove or slot means 78 assures a metered fuel flow into the area 112 of the ignition sparks so as to assure a combustible fuel mixture that will ignite in four seconds maximum and assure that this charge point flame 114 will also envelop the igniter electrode end 104 in such a manner as to provide flame rectification of the probe with any flame size that will burn in a reliable manner as it is well known that the ignition of a top burner by spark discharge is very difficult when subjected to all fuel types, burner ratings and gas pressures required.

However, it is believed that the igniter assembly 59 of this invention will perform under practically all ignition and flame rectification conditions successfully without requiring close manufacturing tolerances which makes it possible to produce the igniter assembly 59 by using ceramic components as provided by standard product vendors.

In particular, it has been found that successful ignition has been obtained using a spark electrode gap 112 of approximately 0.080 of an inch to approximately 0.150 of an inch and permits the length 115 between the tip 113 of the electrode means 101 and the side 109 of the cover member 105 to vary from approxiamtely 0.187 of an inch to approximately 0.275 of an inch without noticeable performance deterioration in both the ignition and rectification performances thereof.

Therefore, it can be seen that it is a really relatively simple method of this invention to form the igniter assembly 59 to be disposed in the burner construction 20 by the method previously set forth to function as a spark electrode means by merely interconnecting a suitable electrical lead of a spark module to the swaged end 103' of the electrode means 101 in a manner conventional in the art so as to cause sparking in the gap 112 between the tip 113 of the electrode means 101 and the cap means 29.

In one working embodiment of this invention, the flat surface 74 of the body member 100 has the distance between the angled sides 76 at the side 77 thereof of approximately 0.379 of an inch with the sides 76 angling toward each other as they approach the side 75 at an angle of approximately 15° so that the length of the groove 78 is approximately 0.375 of an inch with the side 77 being formed on an arc that has a radius of approximately 0.275 of an inch, the groove 78 having the bottom 78' defined on a radius of approximately 0.045 of an inch and a depth of approximately 0.090 of an inch.

The cover member 105 in such one working embodiment has a distance between the sides 108 and 109 thereof of approximately 0.300 of an inch, a distance of approximately 0.379 of an inch between the sides 106' thereof at the side 109 with the rear portion of the surface means 72 tapering at an angle of approximately 15° and beginning at a distance of approximately 0.130 of an inch from the side 108 thereof as illustrated.

However, it is to be understood that such dimensions of the various parts of the igniter assembly 59 of this invention as previously set forth are not to be a limitation on this invention as it is believed that other dimensions can be utilized depending upon various fuel flow rates, pressures, etc.

Thus, it can be seen that this invention not only provides a new burner construction and a new igniter assembly for such a burner construction, but also this invention provides new methods of making such a burner construction and such an igniter assembly.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cap means having an annular surface means cooperating with said annular surface means of said body means to close said groove means on one end thereof whereby said groove means define said port means, said annular surface means of said body means having an igniter receiving slot means therein, and an igniter assembly having a part thereof disposed in said slot means, said igniter assembly comprising an electrically insulating body member having an intermediate portion provided with a groove means therein and having opposed end surface means one of which is disposed adjacent said cap means, and an electrically conductive L-shaped electrode means carried by said body member and having two legs one of which has a first part thereof disposed in said groove means of said body member and has a second part extending out of said intermediate portion for sparking to said cap means, the improvement wherein said one end surface means has a part covering a part of said groove means to separate that said part of said groove means from said cap means and wherein said groove means of said body member leads from said chamber means to said second part of said one leg of said electrode means between said part of said one end surface means and said intermediate portion of said body member for feeding fuel from said chamber means to said second part of said one leg of said electrode means.

2. A burner construction as set forth in claim 1 wherein said body member comprises an electrically insulating cover member secured to said intermediate portion so as to cover said first part of said one leg of said electrode means and to define said part of said one end surface means.

3. A burner construction as set forth in claim 2 wherein said groove means of said body member is generally U-shaped so as to have an open end that is generally closed by said cover member.

4. A burner construction as set forth in claim 3 wherein said first part of said one leg is spaced from said cover member to define a passage therebetween through which said fuel can flow from said chamber means to said second part of said one electrode means.

5. A burner construction as set forth in claim 2 wherein said intermediate portion of said body member has a transverse cross-sectional configuration that generally comprises a truncated triangle.

6. A burner construction as set forth in claim 5 wherein the larger base of said truncated triangle is arcuate.

7. A burner construction as set forth in claim 6 wherein said larger base is convex.

8. A burner construction as set forth in claim 5 wherein said body member has a generally flat top surface that is interrupted by said groove means of said body member that extends from one base of said triangle to another base of said triangle.

9. A burner construction as set forth in claim 8 wherein said cover member covers said groove means of said body member from said one base of said triangle to a point on said flat surface that is short of said other base of said triangle.

10. In an igniter assembly for a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cop means having an annular surface means cooperating with said annular surface means of said body means to close said groove means on one end thereof whereby said groove means define said port means, said annular surface means of said body means having an igniter receiving slot means therein, said igniter assembly being adapted to have a part thereof disposed in said slot means, said igniter assembly comprising an electrically insulating body member having an intermediate portion provided with a grove means therein and having opposed end surface means one of which is adapted to be disposed adjacent said cap means, and an electrically conductive L-shaped electrode means carried by said body member and having two legs one of which has a first part thereof disposed in said groove means of said body member and has a second part extending out of said intermediate portion for sparking to said cap means, the improvement wherein said one end surface means has a part covering a part of said groove means to separate that said part of said groove means from said cap means and wherein said groove means of said body member is adapted to lead from said chamber means to said second part of said one leg of said electrode means between said part of said one end surface means and said intermediate portion of said body member for feeding fuel from said chamber means to said second part of said one leg of said electrode means.

11. An igniter assembly as set forth in claim 10 wherein said body member comprises an electrically insulating cover member secured to said intermediate portion so as to cover said first part of said one leg of said electrode means and to define said part of said one end surface means.

12. An igniter assembly as set forth in claim 11 wherein said groove means of said body member is generally U-shaped so as to have an open end that is generally closed by said cover member.

13. An igniter assembly as set forth in claim 12 wherein said first part of said one leg is spaced from said cover member to define a passage therebetween through which said fuel can flow from said chamber means to said second part of said one electrode means.

14. An igniter assembly as set forth in claim 11 wherein said intermediate portion of said body member has a transverse cross-sectional configuration that generally comprises a truncated triangle.

15. An igniter assembly as set forth in claim 14 wherein the larger base of said truncated triangle is arcuate.

16. An igniter assembly as set forth in claim 15 wherein said larger base is convex.

17. An igniter assembly as set forth in claim 14 wherein said body member has a generally flat top surface that is interrupted by said groove means of said body member that extends from one base of said triangle to another base of said triangle.

18. An igniter assembly as set forth in claim 17 wherein said cover member covers said groove means of said body member from said one base of said triangle to a point on said flat surface that is short of said other base of said triangle.

19. In a method of making a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cap means having an annular surface means cooperating with said annular surface means of said body means to close said groove means on one end thereof whereby said groove means define said port means, said annular surface means of said body means having an igniter receiving slot means therein, and an igniter assembly having a part thereof disposed in said slot means, said igniter assembly comprising an electrically insulating body member having an intermediate portion provided with a groove means therein and having opposed end surface means one of which is disposed adjacent said cap means, and an electrically conductive L-shaped electrode means carried by said body member and having two legs one of which has a first part thereof disposed in said groove means of said body member and has a second part extending out of said intermediate portion for sparking to said cap means, the improvement comprising the step of forming said groove means of said body member to lead from said chamber means to said second part of said one leg of said electrode means between part of said one end surface means and said intermediate portion of said body member for feeding fuel from said chamber means to said second part of said one leg of said electrode means.

20. In a method of making an igniter assembly for a burner construction comprising a burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cap means having an annular surface means cooperating with said annular surface means of said body means to close said groove means on one end thereof whereby said groove means define said port means, said annular surface means of said body means having an igniter receiving slot means therein, said igniter assembly having a part thereof adapted to be disposed in said slot means, said igniter assembly comprising an electrically insulating body member having an intermediate portion provided with a groove means therein and having opposed end surface means one of which is adapted to be disposed adjacent said cap means, and an electrically conductive L-shaped electrode means carried by said body member and having two legs one of which has a first part thereof disposed in said groove means of said body member and has a second part extending out of said intermediate portion for sparking to said cap means, the improvement comprising the step of forming said groove means of said body member to lead from said chamber means to said second part of said one leg of said electrode means between part of said one end surface means and said intermediate portion of said body member for feeding fuel from said chamber means to said second part of said one leg of said electrode means.

* * * * *